US010065073B2

(12) United States Patent
Wheeler

(10) Patent No.: US 10,065,073 B2
(45) Date of Patent: Sep. 4, 2018

(54) FITNESS SYSTEM AND METHOD

(71) Applicant: David B. Wheeler, Osseo, MI (US)

(72) Inventor: David B. Wheeler, Osseo, MI (US)

( * ) Notice: Subject to any disclaimer, the term of this patent is extended or adjusted under 35 U.S.C. 154(b) by 379 days.

(21) Appl. No.: 15/088,724

(22) Filed: Apr. 1, 2016

(65) Prior Publication Data

US 2016/0287936 A1 Oct. 6, 2016

Related U.S. Application Data

(60) Provisional application No. 62/143,485, filed on Apr. 6, 2015.

(51) Int. Cl.
*A63B 71/00* (2006.01)
*A63B 23/04* (2006.01)
(Continued)

(52) U.S. Cl.
CPC .... *A63B 23/0494* (2013.01); *A63B 21/00047* (2013.01); *A63B 69/0028* (2013.01); *A63B 71/0054* (2013.01); *A63B 71/04* (2013.01); *A63B 71/0669* (2013.01); *A63B 2022/0092* (2013.01); *A63B 2022/0097* (2013.01); *A63B 2071/065* (2013.01);
(Continued)

(58) Field of Classification Search
CPC ..... A63B 24/0003; A63B 24/0006; A63B 24/0021; A63B 2024/0009; A63B 2024/0012; A63B 2024/0015; A63B 2024/0025; A63B 2024/0028; A63B 2024/0031; A63B 2024/0034; A63B 2024/0037; A63B 2024/004; A63B 2024/0043; A63B 2024/0046; A63B 2024/005; A63B 2024/0053; A63B 2024/0056; A63B 22/0694; A63B 2022/0092; A63B 23/0476; A63B 23/0494; A63B 21/00047; A63B 71/0054; A63B 71/04; A63B 71/0669; A63B 69/0028; A63B 2071/0625; A63B 2071/065; A63B 2208/0233; A63B 2210/02; A63B 2220/833; A63B 2225/09; A63B 2225/093; A61H 1/0214; A61H 2003/006
See application file for complete search history.

(56) References Cited

U.S. PATENT DOCUMENTS 5,662,560 A 9/1997 Svendsen et al.
6,110,073 A 8/2000 Saur et al.
(Continued)

*Primary Examiner* — Joshua Lee
(74) *Attorney, Agent, or Firm* — Warner Norcross + Judd LLP

(57) ABSTRACT

A training device or apparatus for improving performance speed. In one embodiment, the training device includes first and second surfaces disposed in an opposing manner and defining a space therebetween. The space can allow at least one body part of an athlete to cyclically travel between the first and second surfaces in a plane that intersects both of the first and second surfaces. The athlete can be supported such that the body part is substantially free from external resistance along a direction of travel within the plane. In this way, repeated movement of a body part can occur between the first and second surfaces without fatiguing muscles due to external resistance, thereby lengthening the duration of the training session. The at least one body part can include the feet of the athlete.

17 Claims, 4 Drawing Sheets

(51) Int. Cl.

| | |
|---|---|
| ***A63B 21/00*** | (2006.01) |
| *A63B 69/00* | (2006.01) |
| *A63B 71/04* | (2006.01) |
| *A63B 71/06* | (2006.01) |
| *A63B 22/00* | (2006.01) |

(52) U.S. Cl.

CPC ..... *A63B 2071/0625* (2013.01); *A63B 2208/0233* (2013.01); *A63B 2210/02* (2013.01); *A63B 2220/801* (2013.01); *A63B 2220/802* (2013.01); *A63B 2220/803* (2013.01); *A63B 2220/805* (2013.01); *A63B 2220/833* (2013.01); *A63B 2225/09* (2013.01); *A63B 2225/093* (2013.01)

(56) References Cited

U.S. PATENT DOCUMENTS 6,685,480 B2 * 2/2004 Nishimoto ..... G09B 15/00 434/247
7,236,257 B2 * 6/2007 Rubach ..... A63B 5/00 250/336.1
7,455,621 B1 * 11/2008 Anthony ..... A63B 21/0724 482/3
7,666,118 B1 * 2/2010 Anthony ..... A63B 21/0724 482/104
7,901,325 B2 * 3/2011 Henderson ..... A63B 24/0006 482/8
8,221,295 B2 * 7/2012 Wilkins ..... A63B 5/00 482/130
9,693,734 B2 * 7/2017 Horseman ..... G06F 19/3418
2004/0259689 A1 * 12/2004 Wilkins ..... A63B 5/00 482/8
2005/0159275 A1 * 7/2005 Bullman ..... A63B 69/0035 482/111
2007/0032353 A1 * 2/2007 Wilkins ..... A63B 5/00 482/54
2007/0275830 A1 * 11/2007 Lee ..... A61B 5/1038 482/54
2011/0269601 A1 * 11/2011 Nelson ..... A47C 7/021 482/8
2012/0302301 A1 * 11/2012 Homsi ..... A63B 24/0021 463/2

* cited by examiner

FITNESS SYSTEM AND METHOD

TECHNICAL FIELD

The present application relates to physical fitness, and more particularly to a system and method for improving physical performance speed.

BACKGROUND

The fitness industry has been in a near constant state of advancement, driven in part by the competitive desire of athletes to perform better than their opponents. Training regimens for enhancing performance have been developed and debated for several centuries. But nearly all conventional training regimens involve exercise focused on fatiguing muscles under load. Such loading exercises are often focused on improving two aspects of physical fitness: (1) endurance and (2) strength. Repeatedly fatiguing a muscle under load, also known as resistance training, according to one or more regimens is seen as a path to enhance endurance or strength, or both. For example, a long distance runner can run outdoors or on a track several hours a day in an attempt to maintain or enhance cardiovascular fitness and muscle endurance. As another example, a lineman in the National Football League (NFL) can lift heavy weights several days a week to try to maintain or enhance muscle strength.

Strength of an athlete (and endurance to some extent) is often considered a proxy for performance speed. As a result, regimens for improving performance speed, in many cases, draw from the same school of thought—that is, these regimens in many cases focus on exercising muscles under load to induce muscle fatigue in order to improve physical fitness. As an example, a running back in the NFL can train to improve sprinting speed by running with an additional load, such as additional weight or a parachute.

Regardless of whether the training is focused on improving endurance or strength there can be at least two downsides to repeatedly training muscles under load. First, repeatedly loading muscles can increase the chance of injury. For example, repeated loading can overstress a muscle or an associated joint, potentially sidelining an athlete for a recovery period. Second, regimens involving repeated loading often involve a significant time commitment. Because resistance training and training muscles under load can result in fatigue (indeed fatigue is a primary focus of such training), seriously minded exercise regimens of this type do not lend themselves to multitasking. As a result, higher level athletes typically allot a large amount of their day to focused training. Further, many such exercise regimens are performed outside to benefit from the larger available space, but are avoided during winter due to inclement weather.

SUMMARY OF THE DESCRIPTION

The present disclosure is directed to a training device or apparatus for improving performance speed. In one embodiment, the training device includes first and second surfaces disposed in an opposing manner and defining a space therebetween. The space can allow at least one body part of an athlete to cyclically travel between the first and second surfaces in a plane that intersects both of the first and second surfaces. The athlete can be supported such that the body part is substantially free from external resistance along a direction of travel within the plane. In this way, repeated movement of a body part can occur between the first and second surfaces without fatiguing muscles due to external resistance, thereby lengthening the duration of the training session. The at least one body part can include the feet of the athlete.

In one embodiment, the training device can include one or more sensors configured to provide sensor output indicative of presence of the body part in proximity to at least one of the first and second surfaces. The training device can also include a controller operably coupled to the one or more sensors to receive the sensor output, and configured to determine one or more presence events based on the sensor output. The presence detection events can be used as a basis for determining a performance score associated with a training session of the athlete. For example, the performance score can be based on a number of the one or more presence events that (a) are respectively associated with the one or more sensors and (b) occur during a pre-defined time interval.

The training device can include a frame having a first side that corresponds to the first surface and a second side that corresponds to the second surface, where the frame is constructed to allow the body part to travel back and forth in the plane between the first side and the second side. The one or more sensors of the training device can include a first sensor supported by the first side, and a second sensor supported by the second side. The first sensor can indicate presence of the body part in proximity to the first side, and the second sensor can indicate presence of the body part in proximity to the second side. The controller of the training device can be configured to determine one or more presence detection events based on the sensor output of the first sensor and the second sensor.

In one embodiment, a height of a support used in conjunction with the training device is adjustable to ensure the at least one body part of the athlete hangs free to avoid ground contact. In another aspect, the distance between the first and second sides can be variable to accommodate athletes of different sizes.

In one aspect, a method of improving performance speed of an athlete includes providing first and second surfaces disposed in an opposing relationship such that a plane intersecting both of the first and second surfaces is above a ground plane, and a space above the ground plane is located between the first and second surfaces. The method further includes supporting the athlete relative to the space above the ground plane such that a body part of the athlete is disposed in the space above the ground plane and such that the body part is allowed to cyclically travel between the first and second surfaces in the space and in a direction of travel within the plane that is substantially free from external resistance. In one embodiment, the athlete can cyclically or repeatedly contact each of the first and second surfaces over a period of time to enhance performance speed.

In one embodiment, the method can include sensing presence of the body part in proximity to at least one of the first and second surfaces, and determining at least one presence event based on the presence of the body part being sensed in proximity to at least one of the first and second surfaces. The method can also include calculating a performance score based on a time interval and the at least one presence event.

In one aspect, a system and method according to the current embodiment can be used over the course of several training sessions to aid an athlete in improving performance speed. Because there can be little or no external resistance exerted on a body part along its primary direction of travel, muscle fatigue through repeated movement of the body part can be reduced enabling the athlete to focus the training session on improving performance speed. Further, the training session can avoid repeated loading of the body part to potentially reduce the chance of injury. These and other advantages and features of the invention will be more fully understood and appreciated by reference to the description of the current embodiment and the drawings.

Before the embodiments of the invention are explained in detail, it is to be understood that the invention is not limited to the details of operation or to the details of construction and the arrangement of the components set forth in the following description or illustrated in the drawings. The invention may be implemented in various other embodiments and of being practiced or being carried out in alternative ways not expressly disclosed herein. Also, it is to be understood that the phraseology and terminology used herein are for the purpose of description and should not be regarded as limiting. The use of "including" and "comprising" and variations thereof is meant to encompass the items listed thereafter and equivalents thereof as well as additional items and equivalents thereof. Further, enumeration may be used in the description of various embodiments. Unless otherwise expressly stated, the use of enumeration should not be construed as limiting the invention to any specific order or number of components. Nor should the use of enumeration be construed as excluding from the scope of the invention any additional steps or components that might be combined with or into the enumerated steps or components.

DESCRIPTION

Figure 1:
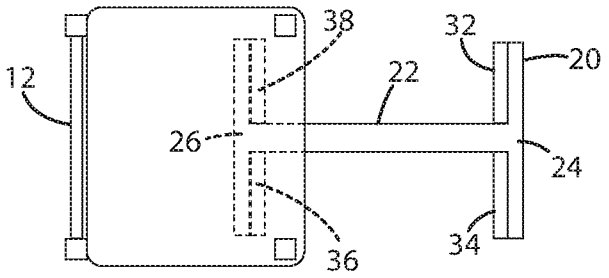
FIG. 1 shows a top representative view of a training apparatus and an athlete support according to a current embodiment of the present disclosure.
Figure 2:
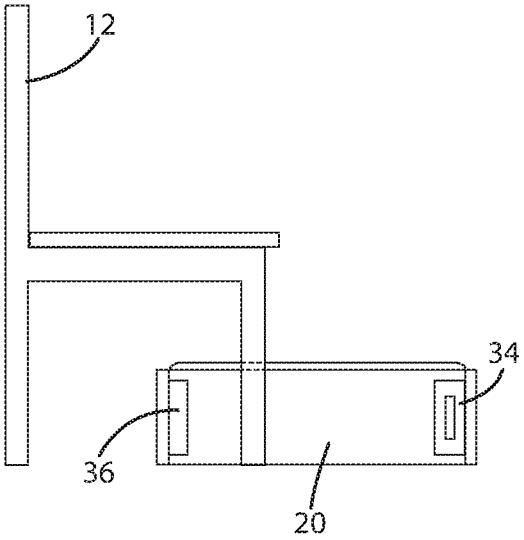
FIG. 2 shows a front representative view of the training apparatus and the athlete support.
Figure 3:
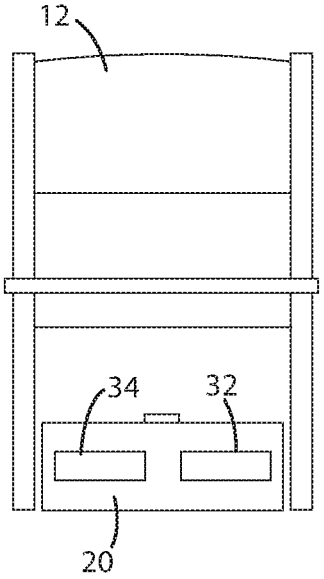
FIG. 3 shows a side representative view of the training apparatus and the athlete support.

A training system for aiding an athlete to improve performance speed according to a training regimen is shown in FIGS. 1-4, and is generally designated 10. The training system can include a training apparatus 20 having a first member 24 and a second member 26 disposed in an opposing manner and defining a space therebetween. The training apparatus 20 can also include a sensor system configured to sense presence of a body part in proximity to at least one of the first and second members 24, 26. It should be understood that sensing presence of the body part in proximity to at least one of the first and second members 24, 26 can include sensing direct contact between the body part and the respective surface. The athlete can be supported by an athlete support 12, such as a conventional chair, in a manner that allows the body part of the athlete to cyclically travel between the first and second opposing members 24, 26 in a plane 52 that intersects both of the first and second opposing members 24, 26. The plane 52 and the body part can be supported above a ground plane 50 or off the ground. The body part can travel within the plane 52 without experiencing substantial external resistance along the direction of travel within the plane 52. In other words, in the direction of travel within the plane 52 and between the first and second members 24, 26, the body part can be substantially free from external resistance.

Figure 4:
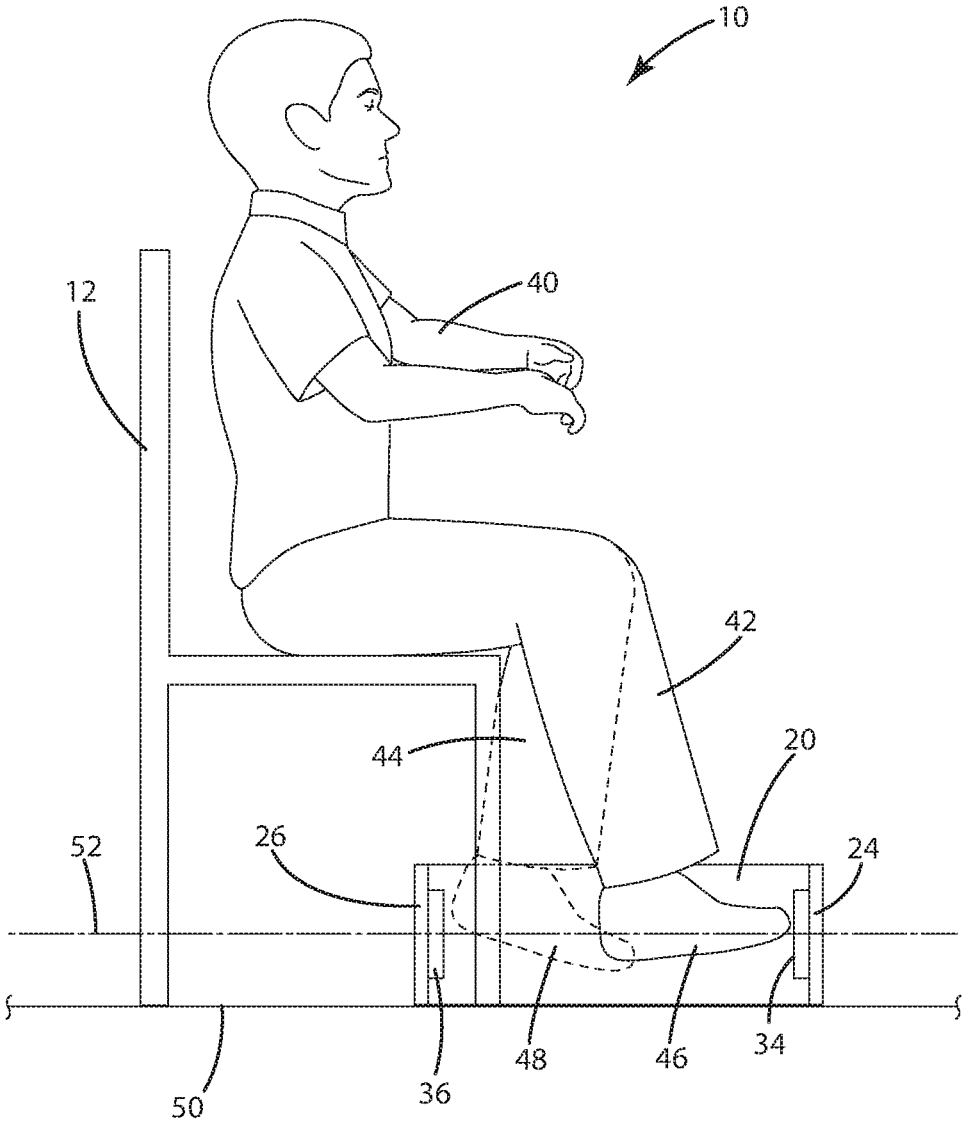
FIG. 4 depicts the training apparatus and the athlete support of FIG. 3 along with an athlete.

The training system 10 can enable the athlete, designated 40 in the illustrated embodiment of FIG. 4, to repeatedly move the body part between the first and second opposing members 24, 26 according to a training regimen. Over several training sessions, this training regimen can aid the athlete 40 in improving performance speed. Because there can be little or no external resistance along the direction of travel within the plane 52, muscle fatigue through repeated movement of the body part can be reduced enabling the athlete 40 to primarily focus the training session on improving performance speed. Performance speed can be affected and enhanced by a number of factors, including, for example, through improving neural speed for particular muscle movements or building fast twitch muscle fibers, or both. The training system 10 according to the current embodiment can enable training efforts to enhance these and other factors, ultimately enabling enhancement of performance speed.

The training system 10 can be utilized within a generally small area that can be repurposed for other uses. For example, in the context of the athlete support 12 being a chair, the chair can be kept in place, such as around a dining room table or living room, and the training apparatus 20 can be stored in a separate location. When the athlete 40 plans to conduct a training session, the training apparatus 20 can be taken out of storage, and placed in position relative to the athlete support 12. In this way, the training system 10 can be utilized indoors without repurposing a specific area for use with training. If outdoor weather conditions are not conducive for training, the athlete 40 can conduct a training session indoors. For example, the athlete 40 can continue to train through long winter months when weather conditions can impede effective training.

The training apparatus 20 in the illustrated embodiments of FIGS. 1-4, includes a base member 22 disposed between the first and second members 24, 26. Together, the base member 22, the first member 24, and the second member 26 can form a frame that supports the sensor system, and enables the athlete 40 to repeatedly move the body part between the first and second members 24, 26. In the illustrated embodiment, the first and second members 24, 26 are generally elongate walls having respective surfaces that oppose each other, and the base member 22 is disposed between the elongate walls and coupled to each of the first and second members 24, 26 generally near the centers thereof. The base member 22 can maintain the positions of the first and second members 24, 26 with respect to each other. It should be understood that the frame of the training apparatus 20 can be configured differently. For example, the first and second members 24, 26 can be coupled to each other via multiple base members. In one example construction, the frame of the training apparatus 20 can form a generally four-sided frame with two sides of the frame corresponding to the first and second members 24, 26. In this example construction, and the construction depicted in the illustrated embodiment of FIGS. 1-4, the frame of the training apparatus 20 can define a space between the first and second members 24, 26 within which a body part of the athlete 40 can freely move in a manner substantially free from external resistance.

In the illustrated embodiment of FIGS. 1-4, the athlete 40 can be supported by the support 12 with his lower legs 42, 44 hanging freely over an edge of the support 12. The right and left feet of the athlete 40, respectively designated 46, 48, are depicted disposed between the first and second members 24, 26, and intersecting the plane 52. The athlete 40, in this position, can repeatedly swing each of the right and left feet 46, 48 back and forth between the first and second members 24, 26. The right and left feet 46, 48 in the illustrated embodiment are substantially free from external resistance along the direction of travel back and forth between the first and second members 24, 26 in the plane 52. The right and left feet 46, 48 in the illustrated embodiment are also disposed off the ground or above the ground plane 50 to substantially avoid ground contact.

The training apparatus 20 can be adjustable such that a user can adjust the distance between the inner, opposing surfaces of the first and second members 24, 26. For example, the base member 22 can be adjustable in length, thereby enabling adjustment of the distance between the inner, opposing surfaces of the first and second members 24, 26. As an example, the base member 22 can include two separate sections arranged in an overlapping configuration. The degree of overlap between the two separate sections can be adjusted to affect the length of the base member 22. Fasteners can be used to affix the two separate sections after the length has been set by the user.

In providing adjustability, the training apparatus 20 can accommodate athletes 40 of different sizes. For example, one athlete 40 can have different size feet 46, 48 from another athlete, affecting the overall distance traversed by each foot in moving back and forth between the first and second members 24, 26. So that each athlete 40 can train using a standard distance, or at an athlete preferred distance, the distance between the inner opposing surfaces of the first and second members 24, 26 can be adjusted to fit a particular athlete 40.

In one embodiment, the support 12 of the training system 10 can be adjustable in height to accommodate athletes 40 of different sizes. Not all athletes 40 are the same height, or have the same lower leg length. As a result, in allowing the support 12 to be adjustable in height, the training system 10 can be configured to a particular size of the athlete 40. In the illustrated embodiment, the height of the support 12 can be increased or decreased to maintain the right and left feet 46, 48 within the space defined between the members 24, 26, and such that the right and left feet 46, 48 are off the ground.

It should be understood that the support 12 can be constructed in a variety of ways. In the illustrated embodiment, the support 12 is a chair, but the support 12 can be different. For example, the support 12 can be a power tower, also known as a roman chair, having forearm pads and substantially vertical handles for supporting a torso and legs of athlete in a generally upright, suspended position. With such a power tower, the athlete 40 can swing their legs back and forth with little effort to hold themselves in position. Further, a body part of the athlete 40, such as the feet or lower legs, can be positioned for use with the training apparatus 20.

The sensor system of the training apparatus 20 can include one or more sensors configured to provide an output indicative of presence of a body part. Examples of such sensors include proximity sensors, ultrasonic sensors, contact sensors, and infrared sensors. It should be understood, however, that the one or more sensors of the sensor system are not limited to these examples, and can include any type of sensor, or combination thereof, configured to sense presence of a body part. In the illustrated embodiment of FIGS. 1-4, the training apparatus 20 includes a left toe sensor 32, a right toe sensor 34, a right heel sensor 36, and a left heel sensor 38. The left toe sensor 32 and the right toe sensor 34 can be supported by the first member 24, and the right heel sensor 36 in the left heel sensor 38 can be supported by the second member 26.

Although described in connection with four sensors, the training apparatus 20 can be configured differently, including, for example, having more or fewer sensors. As an example, the training apparatus 20 can include two sensors, a left toe sensor 32 and a right toe sensor 34. In this circumstance, the athlete 40 can be expected to repeatedly move his right and left feet 46, 48 back and forth between the first and second members 24, 26, but only presence with respect to the first member 24 is sensed.

Figure 5:
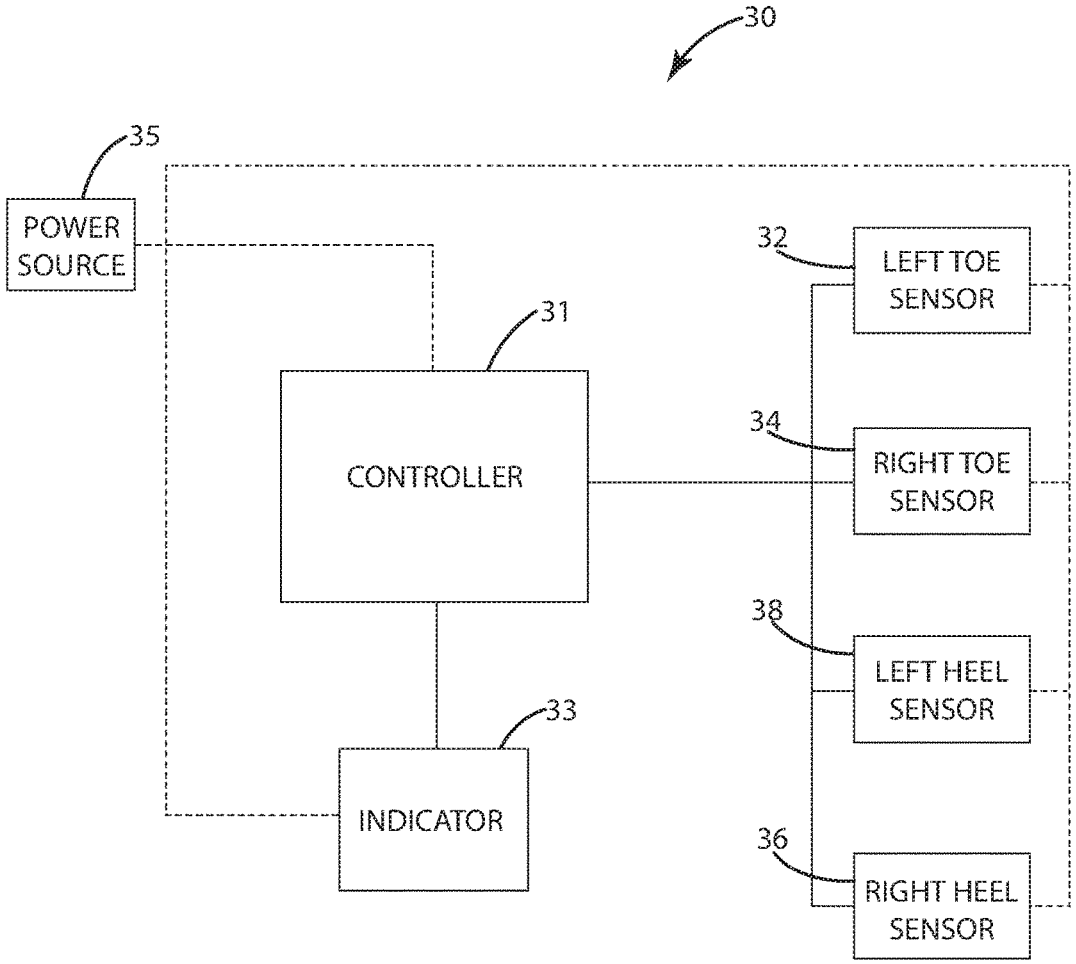
FIG. 5 shows a representative control system of the training apparatus according to the current embodiment.

A control system according to the current embodiment of the present disclosure is shown in FIG. 5, and generally designated 30. The control system 30 can include one or more sensors, including, for example, the left toe sensor 32, the right to sensor 34, the left heel sensor 38, and the right heel sensor 36. The control system 30 can also include a controller 31 operably coupled to sensor output from the one or more sensors. The controller 31 can determine, based on sensor output from a sensor, whether a body part is in proximity to the sensor. For example, if the sensor output from the left toe sensor 32 is indicative of the left foot 48 being in proximity to the first member 24, the controller 31 can determine a presence detection event associated with the left toe sensor 32. Likewise, the controller 31 can determine presence detection events for each of the one or more sensors incorporated into the training apparatus 20.

The controller 31 can be coupled to an indicator 33 capable of conveying information to the athlete. The indicator 33 can be any device capable of conveying information, including, for example, an LCD display, a TFT display, an LED display, or audible feedback. The conveyed information can be a variety of information, such as a suggested regimen for a training session or performance information related to the training session, or both.

In the current embodiment, the controller 31 can remain idle until a training session begins, which can occur in response to a variety of conditions depending on the configuration. For example, a user can activate or begin the training session by selecting an input (not shown) coupled to the controller 31. In response to selection of the input, the controller 31 can begin to monitor sensor output from the one or more sensors. As another example, the controller 31, in an idle state, can monitor the sensor outputs from the one or more sensors. Activation of the training session, or a transition from the idle state to an activation state, can occur in response to presence of a body part being detected in proximity to the one or more sensors.

In the current embodiment, the controller 31 can be configured to start a timer in response to detection of a body part in proximity to one of the one or more sensors. The controller 31 can count or record presence detection events for each of the one or more sensors over a time interval, such as 10 seconds from the initial start of the timer. In this way, over the time interval, the controller 31 can count the number of times each of the feet 46, 48 of the athlete 40 have cycled back and forth between the first and second members 24, 26. A performance score for the given time interval can be displayed on the indicator 33. In the current embodiment, the performance score can correspond to the lowest count of presence detection events associated with one of the two feet 46, 48 of the athlete 40.

In an alternative embodiment, the controller 31 can determine a time interval between each presence detection event associated with one or more sensors associated with a body part. For instance, the controller 31 can determine the time interval between each presence detection event associated with the left toe sensor 32, or can determine the time interval between a presence detection event associate with the left toe sensor 32 and the presence detection event associated with the left heel sensor 38. The athlete 40 can conduct a training session over a period of time, which can be arbitrary or user-defined, and the controller 31 can calculate a performance score based on an average of the recorded time intervals between presence detection events.

By providing information or feedback, such as the performance score, to the athlete 40, the training apparatus 20 can aid the athlete 40 in tracking his progress over several training sessions. As discussed herein, repeated training sessions according to a training regimen with the training apparatus 20 can be used to enhance performance speed of the athlete 40. Because the training apparatus 20 can be configured to present substantially no load on the feet 46, 48 of the athlete 40 in moving back and forth between the first and second members 24, 26, onset of fatigue can be delayed, and the focus of the training regimen can be directed to enhancing performance speed over a longer period of time.

In the illustrated embodiment, the control system 30 can include a power source 35 operably coupled to the controller 31, the indicator 33 and the one or more sensors. It should be understood that not all components of the control system 30 can receive power directly from the power source 35; one or more components of the control system 30 can receive power indirectly from the power source 35 as indicated in broken lines.

Figure 6:
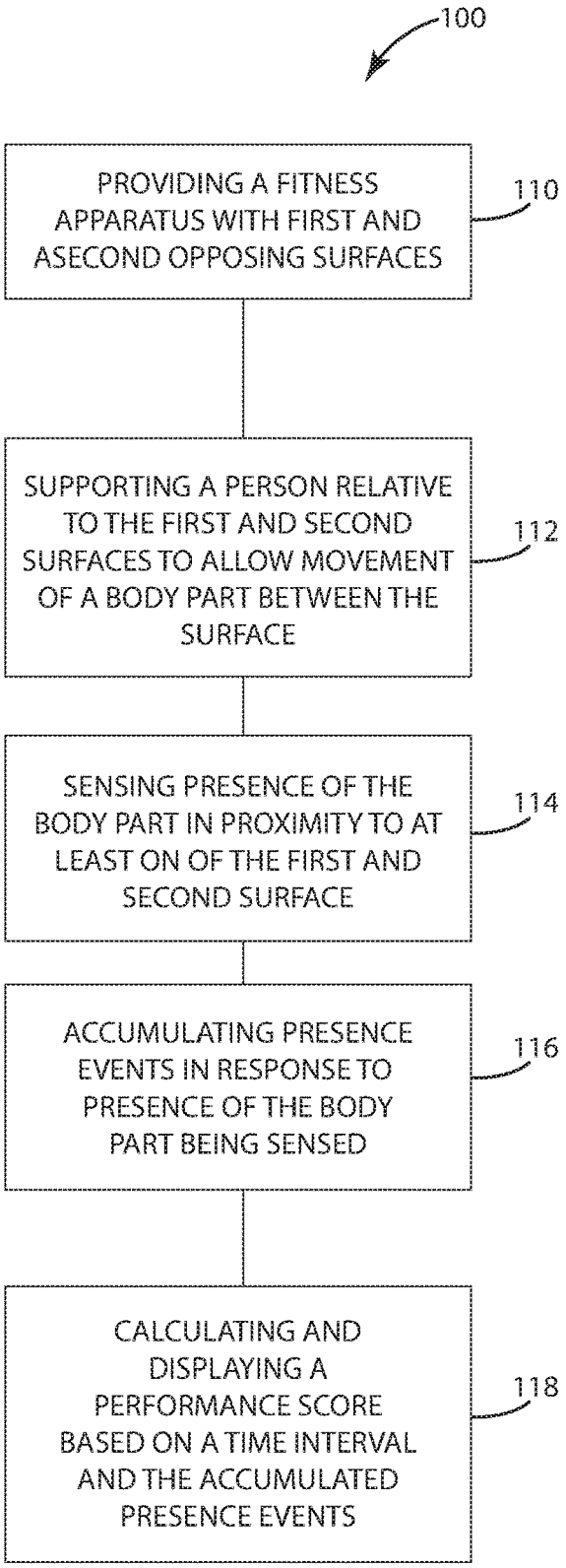
FIG. 6 shows a method of training an athlete to improve performance speed according to the current embodiment.

A method according to one embodiment of the present disclosure is shown in FIG. 6 and generally designated 100. The method 100 can be used in connection with any of the embodiments of the training apparatus 20 described herein, and can include providing such an apparatus with first and second opposing surfaces. Step 110. The method can also include supporting the person or athlete relative to the first and second surfaces to allow movement of at least one body part, such as the feet of the person between the opposing surfaces. Step 112. The person can be supported such that the body part is free to move between the opposing surfaces with substantially no external resistance in a plane that intersects both of the opposing surfaces and that is above a ground plane. In one embodiment, there is substantially no external load on the body part, other than the effects of gravity, and no contact between the body part and the ground.

To enhance performance speed, the athlete can repeatedly move at least one body part back and forth between the opposing surfaces. Performance over the course of several training sessions can be tracked. One or more sensors of the training apparatus can be configured to sense presence of a body part, and can be disposed on or supported by first and second members, which respectively include the first and second opposing surfaces. For example, a first sensor can be disposed on the first member, and can sense presence of the body part in proximity to the first surface. A second sensor can be disposed on the second member, and can sense presence of the body part in proximity to the second surface. Step 114. Each time a sensor indicates presence of the body part in proximity thereto, a presence detection event can be identified.

A controller or processor can be in communication with the one or more sensors to process sensor outputs received therefrom. The controller in one embodiment can accumulate or record presence detection events based on the one or more sensor outputs. Step 116. The controller can further calculate a performance score of a training session based on the presence detection events and a time interval. The time interval can be any period of time, including, for example, a period of time over which presence detection events are recorded, or a time between successive presence detection events. Further, the time interval can be a time between presence detection events associated with different sensors, such as a time interval between a presence detection event associated with a toe sensor and a presence detection event associated with a heel sensor. After calculating the performance score, the controller can communicate the score information to an indicator, such as a display, to convey the information to the athlete. This information can be used by the athlete to track progress and performance speed increases over the course of several training sessions.

Directional terms, such as "vertical," "horizontal," "top," "bottom," "upper," "lower," "inner," "inwardly," "outer" and "outwardly," are used to assist in describing the invention based on the orientation of the embodiments shown in the illustrations. The use of directional terms should not be interpreted to limit the invention to any specific orientation(s).

The above description is that of current embodiments of the invention. Various alterations and changes can be made without departing from the spirit and broader aspects of the invention as defined in the appended claims, which are to be interpreted in accordance with the principles of patent law including the doctrine of equivalents. This disclosure is presented for illustrative purposes and should not be interpreted as an exhaustive description of all embodiments of the invention or to limit the scope of the claims to the specific elements illustrated or described in connection with these embodiments. For example, and without limitation, any individual element(s) of the described invention may be replaced by alternative elements that provide substantially similar functionality or otherwise provide adequate operation. This includes, for example, presently known alternative elements, such as those that might be currently known to one skilled in the art, and alternative elements that may be developed in the future, such as those that one skilled in the art might, upon development, recognize as an alternative. Further, the disclosed embodiments include a plurality of features that are described in concert and that might cooperatively provide a collection of benefits. The present invention is not limited to only those embodiments that include all of these features or that provide all of the stated benefits, except to the extent otherwise expressly set forth in the issued claims. Any reference to claim elements in the singular, for example, using the articles "a," "an," "the" or "said," is not to be construed as limiting the element to the singular. Any reference to claim elements as "at least one of X, Y and Z" is meant to include any one of X, Y or Z individually, and any combination of X, Y and Z, for example, X, Y, Z; X, Y; X, Z; and Y, Z.

The invention claimed is:

1. A training device for improving performance speed, said training device comprising:

first and second surfaces disposed in an opposing manner and defining a space therebetween, said space being configured to allow a body part to cyclically travel between said first and second surfaces in a plane that intersects both of said first and second surfaces, wherein the body part is substantially free from external resistance along a direction of travel within said plane and between said first and second surfaces;

one or more sensors configured to provide sensor output indicative of presence of the body part in proximity to at least one of said first and second surfaces;

a controller operably coupled to said one or more sensors to receive said sensor output, said controller configured to determine one or more presence events based on said sensor output indicating the body part is present in proximity to said at least one of said first and second surfaces, said controller configured to determine a performance score based on a time interval and said one or more presence events;

a frame having a first side that corresponds to said first surface and a second side that corresponds to said second surface, wherein said frame is constructed to allow the body part to travel back and forth in said plane between said first side and said second side;

wherein said one or more sensors includes a first sensor and a second sensor, wherein said first sensor is supported by said first side, wherein said second sensor is supported by said second side;

wherein a first sensor output of said first sensor is indicative of presence of the body part in proximity to said first side, wherein a second sensor output of said second sensor is indicative of presence of the body part in proximity to said second side; and wherein said controller is configured to determine said one or more presence events in response to one of said first sensor output and said second sensor output being indicative of presence, wherein said performance score is based on a total number of determined presence events for a given time interval; and wherein the body part is at least one foot of a person, wherein the training device further comprises a chair to support the person such that the at least one foot of the person hangs free and intersects said plane, wherein the at least one foot is capable of being swung back and forth between said first and second sides.

2. The training device as claimed in claim 1 wherein said performance score is based on a number of said one or more presence events that occur during a pre-defined time interval.

3. The training device as claimed in claim 1 wherein said controller is configured to determine a plurality of time intervals between successive presence events, wherein said performance score is based on an average of said plurality of time intervals.

4. The training device of claim 1 wherein a support height of said chair is adjustable to ensure the at least one foot of the person hangs free to avoid ground contact, wherein said first sensor is a toe presence sensor and said second sensor is a heel presence sensor.

5. The training device of claim 1 wherein a distance between said first and second sides is adjustable to accommodate people of different sizes.

6. The training device of claim 1 wherein said one or more sensors further includes a third sensor and a fourth sensor, wherein said third sensor is supported by said first side, wherein said fourth sensor is supported by said second side;

wherein the at least one foot includes right and left feet, wherein said first sensor and said second sensor are disposed to sense presence of the right foot, and wherein said third sensor and said fourth sensor are disposed to sense presence of the left foot.

7. The training device of claim 1 wherein said space is configured to allow the body part to move in said plane in a manner that is substantially unloaded.

8. The training device of claim 1 wherein cyclically moving the body part between said first and second sides such that the body part is free from external resistance along said direction of travel within said plane according to a training regimen improves performance speed of the body part in said direction of travel.

9. A method of improving performance speed of an athlete, said method comprising:

providing first and second surfaces disposed in an opposing relationship such that a plane intersecting both the first and second surfaces is above a ground plane, wherein a space above the ground plane is located between the first and second surfaces;

supporting the athlete relative to the space above the ground plane such that a body part of the athlete is disposed in the space above the ground plane and such that the body part is allowed to cyclically travel between the first and second surfaces in the space in a direction of travel within the plane that is substantially free from external resistance;

sensing a presence of the body part in proximity to at least one of the first and second surfaces;

determining at least one presence event based on the presence of the body part being sensed in proximity to at least one of the first and second surfaces; and calculating a performance score based on a time interval and the at least one presence event;

wherein said supporting the athlete includes providing a chair capable of supporting the athlete in a sitting position with both feet of the athlete generally hanging within the space.

10. The method of claim 9 wherein said calculating includes determining the performance score based on a number of the at least one presence events that occur during a pre-defined time interval.

11. The method of claim 9 wherein said determining includes identifying a plurality of time intervals between successive presence events, and wherein said calculating includes calculating the performance score based on an average of the plurality of time intervals.

12. The method of claim 9 wherein the body part includes a left foot of the athlete and a right foot of the athlete, wherein the left foot and the right foot are substantially free from external resistance along the direction of travel within the plane;

wherein said sensing further includes detecting presence of the left foot in proximity to at least one of the first and second surfaces, wherein said sensing further includes detecting presence of the right foot in proximity to at least one of the first and second surfaces;

wherein said determining at least one presence event includes determining a presence detection count for each of the left and right feet for each of the first and second surfaces.

13. The method of claim 12 wherein said sensing includes detecting contact between the toe of the left and right feet and the first surface, and detecting contact between the heel of the left and right feet and the second surface.

14. The method of claim 12 wherein said calculating includes determining the performance score based on a lowest presence detection count for each of the left and right feet for each of the first and second surfaces; and further comprising adjusting a height of a support for the athlete to position the body part in the space above the ground plane.

15. The method of claim 9 further comprising adjusting a distance between the first and second surfaces to provide sufficient travel distance for the body part to move back and forth between the first and second surfaces in a manner that enhances performance speed of the body part over multiple training sessions.

16. The method of claim 15 wherein the sufficient travel distance is a standard distance for each athlete in dependence on the shoe size of the athlete.

17. The method of claim 9 wherein the chair is a power tower having forearm pads and substantially vertical handles for supporting a torso and legs of the athlete in a generally upright, suspended position.

* * * * *